US011137181B2

(12) United States Patent
Longsworth

(10) Patent No.: US 11,137,181 B2
(45) Date of Patent: Oct. 5, 2021

(54) GAS BALANCED ENGINE WITH BUFFER

(71) Applicant: SUMITOMO (SHI) CRYOGENICS OF AMERICA, INC., Allentown, PA (US)

(72) Inventor: Ralph C. Longsworth, Allentown, PA (US)

(73) Assignee: SUMITOMO (SHI) CRYOGENIC OF AMERICA, INC., Allentown, PA (US)

( * ) Notice: Subject to any disclaimer, the term of this patent is extended or adjusted under 35 U.S.C. 154(b) by 331 days.

(21) Appl. No.: 15/563,055

(22) PCT Filed: Jun. 3, 2016

(86) PCT No.: PCT/US2016/035672
§ 371 (c)(1),
(2) Date: Sep. 29, 2017

(87) PCT Pub. No.: WO2016/196898
PCT Pub. Date: Dec. 8, 2016

(65) Prior Publication Data

US 2018/0066878 A1 Mar. 8, 2018

Related U.S. Application Data

(60) Provisional application No. 62/170,408, filed on Jun. 3, 2015.

(51) Int. Cl.
*F25B 9/14* (2006.01)
*F25B 41/20* (2021.01)
*F25B 9/06* (2006.01)

(52) U.S. Cl.
CPC ..... *F25B 41/20* (2021.01); *F25B 9/06* (2013.01); *F25B 9/14* (2013.01)

(58) Field of Classification Search
CPC ..... F25B 9/14; F25B 9/145
See application file for complete search history.

(56) References Cited

U.S. PATENT DOCUMENTS 1,462,655 A 7/1923 Philip
2,607,322 A 8/1952 Collins
(Continued)

FOREIGN PATENT DOCUMENTS

CN 1892931 A 1/2007
CN 101109583 A 1/2008
(Continued)

OTHER PUBLICATIONS

British Examination Report dated Mar. 8, 2018 for the Related British Patent Application No. GB1510022.5.
(Continued)

*Primary Examiner* — John F Pettitt, III
(74) *Attorney, Agent, or Firm* — Katten Muchin Rosenman LLP

(57) ABSTRACT

An expansion engine operating on a Brayton cycle which is part of a system for producing refrigeration at cryogenic temperatures that includes a compressor, a counter-flow heat exchanger, and a load that may be remote, which is cooled by gas circulating from the engine. The engine has a piston in a cylinder which has nearly the same pressure above and below the piston while it is moving. A valve connecting the warm end of the cylinder to a buffer tank allows a partial expansion and recompression of gas in the cold displaced volume that increases the refrigeration produced in each cycle with the same compressor flow rate.

15 Claims, 5 Drawing Sheets

(56) References Cited

U.S. PATENT DOCUMENTS

| | | | | |
|---|---|---|---|---|
| 3,010,220 | A | 11/1961 | Schueller | |
| 3,045,436 | A | 7/1962 | Gifford et al. | |
| 3,119,237 | A | 1/1964 | Gifford | |
| 3,175,373 | A | 3/1965 | Holkeboer et al. | |
| 3,205,668 | A | 9/1965 | Gifford | |
| 3,338,063 | A | 8/1967 | Hogan et al. | |
| 3,613,385 | A | 10/1971 | Hogan et al. | |
| 3,620,029 | A | 11/1971 | Longsworth | |
| 3,768,273 | A | 10/1973 | Missimer | |
| 4,132,505 | A | 1/1979 | Schuman | |
| 4,150,549 | A | 4/1979 | Longsworth | |
| 4,372,128 | A | 2/1983 | Sarcia | |
| 4,484,458 | A | 11/1984 | Longsworth | |
| 4,543,794 | A | 10/1985 | Matsutani et al. | |
| 4,951,471 | A | 8/1990 | Sakitani et al. | |
| 4,987,743 | A | 1/1991 | Lobb | |
| 5,094,277 | A | 3/1992 | Grant | |
| 5,181,383 | A | 1/1993 | Goto et al. | |
| 5,193,348 | A | 3/1993 | Schnapper | |
| 5,361,588 | A | 11/1994 | Asami | |
| 5,386,708 | A | 2/1995 | Kishorenath et al. | |
| 5,387,252 | A * | 2/1995 | Nagao | F25B 9/10 62/196.2 |
| 5,398,512 | A | 3/1995 | Inaguchi et al. | |
| 5,461,873 | A | 10/1995 | Longsworth | |
| 5,481,878 | A | 1/1996 | Shaowei | |
| 5,582,017 | A | 12/1996 | Noji et al. | |
| 5,590,533 | A | 1/1997 | Asami et al. | |
| 5,687,574 | A | 11/1997 | Longsworth et al. | |
| 6,038,866 | A | 3/2000 | Okamoto et al. | |
| 6,161,392 | A | 12/2000 | Jirnoa et al. | |
| 6,205,791 | B1 | 3/2001 | Smith, Jr. | |
| 6,256,997 | B1 | 7/2001 | Longsworth | |
| 6,347,522 | B1 | 2/2002 | Maguire et al. | |
| 6,374,617 | B1 | 4/2002 | Bonaquist et al. | |
| 6,415,611 | B1 | 7/2002 | Acharya et al. | |
| 6,438,994 | B1 | 8/2002 | Rashad et al. | |
| 6,530,237 | B2 | 3/2003 | Morse et al. | |
| 6,574,978 | B2 | 6/2003 | Flynn et al. | |
| 6,625,992 | B2 | 9/2003 | Maguire et al. | |
| 6,923,009 | B2 | 8/2005 | Kudaravalli | |
| 7,127,901 | B2 | 10/2006 | Dresens et al. | |
| 7,249,465 | B2 | 7/2007 | Arman et al. | |
| 8,448,461 | B2 | 5/2013 | Longsworth | |
| 8,776,534 | B2 | 7/2014 | Dunn et al. | |
| 8,783,045 | B2 | 7/2014 | Xu et al. | |
| 9,080,794 | B2 | 7/2015 | Longsworth | |
| 9,546,647 | B2 | 1/2017 | Longsworth | |
| 2003/0233826 | A1 | 12/2003 | Luo | |
| 2005/0016187 | A1 | 1/2005 | Kudaravalli | |
| 2007/0119188 | A1 | 5/2007 | Xu et al. | |
| 2007/0214821 | A1 | 9/2007 | Astra | |
| 2007/0245749 | A1 | 10/2007 | Atkins et al. | |
| 2007/0253854 | A1 | 11/2007 | Dunn | |
| 2008/0092588 | A1 | 4/2008 | Xu et al. | |
| 2010/0016168 | A1 | 1/2010 | Atkins et al. | |
| 2010/0275616 | A1 | 11/2010 | Saji et al. | |
| 2011/0219810 | A1 | 9/2011 | Longsworth | |
| 2012/0017607 | A1 | 1/2012 | Bin-Nun et al. | |
| 2012/0085121 | A1 | 4/2012 | Longsworth | |
| 2012/0227417 | A1 * | 9/2012 | Chao | F25B 9/14 62/6 |
| 2013/0008190 | A1 | 1/2013 | Longsworth | |
| 2013/0067952 | A1 | 3/2013 | Ri et al. | |
| 2013/0285663 | A1 | 10/2013 | Ri et al. | |
| 2014/0290278 | A1 | 10/2014 | Dunn et al. | |
| 2015/0226465 | A1 | 8/2015 | Longsworth | |
| 2015/0354865 | A1 | 12/2015 | Longsworth | |

FOREIGN PATENT DOCUMENTS

| | | | |
|---|---|---|---|
| CN | 101469689 | A | 7/2009 |
| CN | 102290187 | A | 12/2011 |
| DE | 31 09 681 | A1 | 9/1982 |
| DE | 101 90 484 | T1 | 6/2002 |
| DE | 11 2005 003 132 | T5 | 2/2008 |
| DE | 11 2011 100 912 | T5 | 1/2013 |
| EP | 0101565 | A1 | 2/1984 |
| EP | 0919722 | B1 | 7/2003 |
| EP | 2211124 | A1 | 7/2010 |
| EP | 2 562 489 | A1 | 2/2013 |
| EP | 2562489 | A1 | 2/2013 |
| JP | 57-58302 | | 4/1982 |
| JP | 58-112305 | | 7/1983 |
| JP | 63-259357 | A | 10/1988 |
| JP | 1-269874 | A | 10/1989 |
| JP | 3-237276 | | 10/1991 |
| JP | 4-236069 | | 8/1992 |
| JP | 05079717 | A | 3/1993 |
| JP | 5-126426 | A | 5/1993 |
| JP | 6-42405 | A | 2/1994 |
| JP | H06-042405 | A | 2/1994 |
| JP | 06-101917 | | 4/1994 |
| JP | 08-222429 | A | 8/1996 |
| JP | 08-279412 | | 10/1996 |
| JP | 9-324958 | A | 12/1997 |
| JP | 10-089789 | A | 4/1998 |
| JP | 11-63697 | | 3/1999 |
| JP | 11-063697 | A | 3/1999 |
| JP | 11-248280 | | 9/1999 |
| JP | 2000-506584 | A | 5/2000 |
| JP | 2001355929 | A | 12/2001 |
| JP | 2003-139427 | A | 5/2003 |
| JP | 2003-523496 | A | 8/2003 |
| JP | 2005-28132 | | 2/2005 |
| JP | 2006-274939 | A | 10/2006 |
| JP | 2006-275120 | A | 10/2006 |
| JP | 2008-527308 | A | 7/2008 |
| JP | 2008249201 | A | 10/2008 |
| JP | 5095417 | B2 | 12/2012 |
| JP | 2013-522576 | A | 6/2013 |
| JP | 2014-513269 | A | 5/2014 |
| SU | 1325195 | | 7/1987 |
| WO | 97/33671 | | 9/1997 |
| WO | 97/33671 | A1 | 9/1997 |
| WO | 2006/075982 | A1 | 7/2006 |
| WO | 2008/094357 | | 8/2008 |
| WO | 2008/133965 | A1 | 11/2008 |
| WO | 2011/115790 | A2 | 9/2011 |
| WO | 2011/132231 | A1 | 10/2011 |
| WO | 2012/154299 | A1 | 11/2012 |
| WO | 2013/006299 | A1 | 1/2013 |

OTHER PUBLICATIONS

International Search Report and Written Opinion dated Mar. 26, 2013, from the corresponding PCT/US2012/048321.

Japanese Office Action dated Dec. 15, 2015 for the Corresponding Japanese Patent Application No. 2015-523063.

Chinese Office Action dated Nov. 16, 2015 for the Corresponding Chinese Patent Application No. 201280074903.3.

British Office Action dated Apr. 4, 2016 for the Corresponding British Patent Application No. GB1501346.9.

Japanese Office Action dated Aug. 31, 2016 for the Corresponding Japanese Patent Application No. 2015-523063.

British Examination Report dated Aug. 5, 2016 for the Corresponding British Patent Application No. GB1501346.9.

Japanese Office Action dated May 30, 2017 for the Corresponding Japanese Patent Application No. 2015-523063.

Korean Office Action dated Jun. 12, 2017 for the Corresponding Korean Patent Application No. 10-2015-7004486.

German Office Action dated Aug. 1, 2017 for the Corresponding German Patent Application No. 11 2012 006 734.7.

U.S. Office Action dated Aug. 29, 2017 from corresponding U.S. Appl. No. 14/406,982.

U.S. Office Action dated Sep. 28, 2017 from corresponding U.S. Appl. No. 14/693,486.

U.S. Office Action dated Jan. 24, 2018 from corresponding U.S. Appl. No. 14/693,486.

U.S. Office Action dated Jan. 30, 2018 from corresponding U.S. Appl. No. 14/406,982.

(56) References Cited

OTHER PUBLICATIONS

International Preliminary Report on Patentability dated Dec. 5, 2017, from the corresponding PCT/US2016/035672.
Korean Office Action dated Jan. 31, 2018 for the Corresponding Korean Patent Application No. 10-2015-7004486.
German Office Action dated Jan. 17, 2019 for the Corresponding German Patent Application No. 11 2012 006 734.7.
Korean Office Action dated Aug. 21, 2018 for the Corresponding Korean Patent Application No. 10-2018-7018890.
U.S. Office Action dated Aug. 27, 2018 from corresponding U.S. Appl. No. 14/693,486.
German Office Action dated Mar. 30, 2016 for the Corresponding German Patent Application No. 11 2014 000 403.0.
Korean Office Action dated Nov. 4, 2015 for the Corresponding Korean Patent Application No. 10-2015-7021208.
International Search Report and the Written Opinion of the International Searching Authority dated Oct. 4, 2012, from corresponding International Application No. PCT/US2012/044104.
R. Khefer. Cryopumps-Refrigerators, Kriovakuumnaya tekhnika. Osnovy i primeneniya. Moskva, Energoatomizdat, 1983, p. 144-145.
Korean Office Action dated Mar. 25, 2014 from corresponding Korean Application No. 10-2014-7001333, with English-language translation.
Extended European Search Report dated Mar. 26, 2015 for the Corresponding European Patent Application No. 12807347.5.
European Office Action dated Nov. 24, 2015 for the Corresponding European Patent Application No. 12807347.5.
Chinese Office Action dated Jan. 12, 2016 for the Corresponding Chinese Patent Application No. 201280043152.9.
European Office Action dated Apr. 1, 2016 for the Corresponding European Patent Application No. 12807347.5.
U.S. Office Action dated Apr. 9, 2019 from corresponding U.S. Appl. No. 14/406,982.
Korean Office Action dated May 30, 2018 for the Corresponding Korean Patent Application No. 10-2015-7004486.
Japanese Office Action dated Jul. 17, 2018 for the Corresponding Japanese Patent Application No. 2015-523063.
International Search Report and Written Opinion dated Apr. 18, 2014, from the corresponding PCT/US2014/010054.
Japanese Office Action dated Jul. 12, 2016 for the Corresponding Japanese Patent Application No. 2015-552664.
Chinese Office Action dated Jun. 17, 2016 for the Corresponding Chinese Patent Application No. 201480004578.2.
International Search Report and Written Opinion dated Feb. 17, 2012, from the corresponding PCT/US2011/054694.
File History of U.S. Appl. No. 13/039,763.
U.S. Office Action dated Sep. 20, 2012 from corresponding U.S. Appl. No. 13/252,244.
U.S. Notice of Allowance dated Feb. 1, 2013 from corresponding U.S. Appl. No. 13/252,244.
British Examination Report dated Sep. 13, 2018 for the Corresponding British Patent Application No. GB1510022.5.
Japanese Office Action dated Sep. 25, 2018 for the Corresponding Japanese Patent Application No. 2017-552024.
International Search Report and Written Opinion dated Aug. 24, 2016, from the corresponding PCT/US2016/035672.
Chinese Office Action dated Dec. 3, 2014 for the Corresponding Chinese Patent Application No. 201280043152.9.
Specification and Drawings of U.S. Appl. No. 13/106,218 cited in the specification.
C.B. Hood, et al. "Helium Refrigerators for Operation in the 10-30 K Range" Advances in Cryogenic Engineering, vol. 9, Plenum Press, New York (1964), pp. 496-506.
U.S. Office Action dated Jun. 29, 2016 from corresponding U.S. Appl. No. 14/655,853.
U.S. Office Action dated Dec. 9, 2016 from corresponding U.S. Appl. No. 14/655,853.
U.S. Notice of Allowance dated Jul. 26, 2017 from corresponding U.S. Appl. No. 14/655,853.
U.S. Office Action dated Oct. 10, 2014 from corresponding U.S. Appl. No. 13/489,635.
U.S. Office Action dated Jul. 2, 2015 from corresponding U.S. Appl. No. 13/489,635.
U.S. Office Action dated Dec. 17, 2015 from corresponding U.S. Appl. No. 13/489,635.
U.S. Office Action dated Jul. 15, 2016 from corresponding U.S. Appl. No. 13/489,635.
U.S. Notice of Allowance dated Sep. 22, 2016 from corresponding U.S. Appl. No. 13/489,635.
German Office Action dated Jul. 17, 2017 for the Corresponding German Patent Application No. 11 2014 000 403.0.
Japanese Office Action dated Dec. 4, 2018 for the Corresponding Japanese Patent Application No. 2015-523063.
Korean Office Action dated Jan. 4, 2019 for the Corresponding Korean Patent Application No. 10-2017-7036607.
U.S. Office Action dated Jan. 14, 2019 from corresponding U.S. Appl. No. 14/406,982.
Chinese Office Action dated Sep. 9, 2019 for the Corresponding Chinese Patent Application No. 201680032147.6.
German Office Action dated Oct. 28, 2019 for the Corresponding German Patent Application No. 11 2016 002 485.1.
U.S. Office Action dated Nov. 27, 2019, from corresponding U.S. Appl. No. 14/406,982.
Korean Office Action dated Dec. 26, 2019, for the Corresponding Korean Patent Application No. 10-2015-7004486.
U.S. Notice of Allowance dated Feb. 5, 2020, from corresponding U.S. Appl. No. 14/406,982.
British Examination Report dated May 1, 2020, for the Corresponding British Patent Application No. GB1716152.2.
U.S. Office Action dated Jul. 17, 2019 from corresponding U.S. Appl. No. 14/406,982.

* cited by examiner

GAS BALANCED ENGINE WITH BUFFER

BACKGROUND OF THE INVENTION

1. Field of the Invention

This invention relates to an expansion engine operating on the Brayton cycle to produce refrigeration at cryogenic temperatures.

2. Background Information

A system that operates on the Brayton cycle to produce refrigeration consists of or includes a compressor that supplies gas at a discharge pressure to a heat exchanger, from which gas is admitted to an expansion space through an inlet valve, expands the gas adiabatically, exhausts the expanded gas (which is colder) through in outlet valve, circulates the cold gas through a load being cooled, then returns the gas through the heat exchanger to the compressor. U.S. Pat. No. 2,607,322 by S. C. Collins, a pioneer in this field, has a description of the design of an early expansion engine that has been widely used to liquefy helium. The expansion piston is driven in a reciprocating motion by a crank mechanism connected to a fly wheel and generator/motor. The intake valve is opened with the piston at the bottom of the stroke (minimum cold volume) and high pressure gas drives the piston up which causes the fly wheel speed to increase and drive the generator. The intake valve is closed before the piston reaches the top and the gas in the expansion space drops in pressure and temperature. At the top of the stroke the outlet valve opens and gas flows out as the piston is pushed down, driven by the fly wheel as it slows down. Depending on the size of the fly wheel it may continue to drive the generator/motor to output power or it may draw power as it acts as a motor.

Many subsequent engines have designs that are similar. All have atmospheric air acting on the warm end of the piston and have been designed primarily to liquefy helium. Return gas is near atmospheric pressure and supply pressure is approximately 10 to 15 atmospheres. Compressor input power is typically in the range of 15 to 50 kW. Lower power refrigerators typically operate on the GM, pulse tube, or Stirling cycles. Higher power refrigerators typically operate on the Brayton or Claude cycles using turbo-expanders. The lower power refrigerators use regenerator heat exchanges in which the gas flows back and forth through a packed bed, gas never leaving the cold end of the expander. This is in contrast to the Brayton cycle refrigerators that can distribute cold gas to a remote load.

There are two important thermodynamic factors to consider in the design of a Brayton expansion engine. The first is the ability to recover the work produced by the engine. In an ideal engine the Carnot principal states that the ratio of the ideal work input, Wi, to the cooling produced, Q, is proportional to (Ta−Tc)/Tc if work is recovered, Ta being ambient temperature and Tc being the cold temperature, and is proportional to Ta/Tc if work is not recovered. For an ambient temperature of 300K and a cold temperature of 4K the loss without work recovery is 1.4%. For Tc=80K the loss is 27%. The second loss is due to the incomplete expansion of the gas. Ideally the cold inlet valve that admits gas at high pressure to the expansion space is closed and the piston continues to expand the gas until it reaches the low return pressure. For adiabatic expansion of helium from 2.2 MPa to 0.8 MPa 30% more cooling is available with complete expansion than with no expansion. Even expanding to 1.6 MPa provides an additional 16% of cooling.

U.S. Pat. No. 6,205,791 by J. L. Smith describes an expansion engine that has a free floating piston with working gas (helium) around the piston. Gas pressure above the piston, the warm end, is controlled by valves connected to two buffer volumes, one at a pressure that is at about 75% of the difference between high and low pressure, and the other at about 25% of the pressure difference. Electrically activated inlet, outlet, and buffer valves are timed to open and close so that the piston is driven up and down with a small pressure difference above and below the piston, so very little gas flows through the small clearance between the piston and cylinder. A position sensor in the piston provides a signal that is used to control the timing of opening and closing the four valves. If one thinks of a pulse tube as replacing a solid piston with a gas piston then the same "two buffer volume control" is seen in U.S. Pat. No. 5,481,878 by Zhu Shaowei.

FIG. 3 of the '878 Shaowei patent shows the timing of opening and closing the four control valves and FIG. 3 of the '791 Smith patent shows the favorable P-V diagram that can be achieved by good timing of the relationship between piston position and opening and closing of the control valves. The area of the P-V diagram is the work that is produced, and maximum efficiency is achieved by minimizing the amount of gas that is drawn into the expansion space between points 1 and 3 of the '791 FIG. 3 diagram relative to the P-V work, (which equals the refrigeration produced).

The timing of opening and closing the inlet and outlet valves relative to the position of the piston is important to achieve good efficiency. Most of the engines that have been built for liquefying helium have used cam actuated valves similar to those of the '220 Collins patent. The '791 Smith, patent show electrically actuated valves. Other mechanisms include a rotary valve on the end of a Scotch Yoke drive shaft as shown in U.S. Pat. No. 5,361,588 by H. Asami et al and a shuttle valve actuated by the piston drive shaft as shown in U.S. Pat. No. 4,372,128 by Sarcia. An example of a multi-ported rotary valve is found in U.S. patent application 2007/0119188 by M. Xu et al.

U.S. Ser. No. 61/313,868 dated Mar. 15, 2010 by R. C. Longsworth describes a reciprocating expansion engine operating on a Brayton cycle in which the piston has a drive stem at the warm end that is driven by a mechanical drive, or gas pressure that alternates between high and low pressures, and the pressure at the warm end of the piston in the area around the drive stem is essentially the same as the pressure at the cold end of the piston while the piston is moving. The pressure on the warm end of the piston is controlled by a pair of valves that connect the warm displaced volume to the low pressure line while the piston is moving towards the cold end, and to the high pressure line when the piston is moving towards the warm end. This provides some work recovery in the form of the low pressure gas that is drawn into the warm displaced volume being compressed and added to the gas in the high pressure line. Another means of maintaining a pressure on the warm end of the piston that is nearly the same as the pressure at the cold end while the piston is moving is described in U.S. Pat. No. 8,776,534 by R. C. Longsworth. This expansion engine differs from the '868 application by replacing the valve at the warm end that connects the low pressure line to the warm displaced volume with one that connects the high pressure line to the displaced volume while the piston is moving toward the cold end. Another valve in parallel with that is added to rapidly pressurize the warm displaced volume while the piston is at the cold end. This has the advantage relative to the '868 application that no active valves are needed at the warm end but it has the disadvantage that there is no recovery of any of the power put out by the expansion of gas at the cold end.

Patent application Ser. No. 61/391,207 dated Oct. 8, 2010 by R. C. Longsworth describes the control of a reciprocating expansion engine operating on a Brayton cycle, as described in the previous applications, that enables it to minimize the time to cool a mass to cryogenic temperatures. These mechanisms can be used in the present application but are not described here.

SUMMARY OF THE INVENTION

The present invention improves the efficiency of the engines described in the '868 application and U.S. Pat. No. 8,776,534 by adding a buffer volume at the warm end to enable a partial expansion of the gas. A valve is added that connects the warm displaced volume to a buffer volume that is near an average pressure between the high and low pressures, which is a pressure between the high and low pressures (i.e., an intermediate pressure). This permits the cold inlet valve to be closed before the piston reaches the warm end and allows the piston to continue to move toward the warm end and expand the cold gas as the pressure at the warm end of the piston drops towards the average pressure or intermediate pressure in the buffer volume. Gas flows into the buffer volume during this phase of the cycle and flows out when the piston is at or near the cold end and before the cold inlet valve is opened or flows out before the cold inlet valve is opened.

DESCRIPTIONS OF THE PREFERRED EMBODIMENTS

Figure 1:
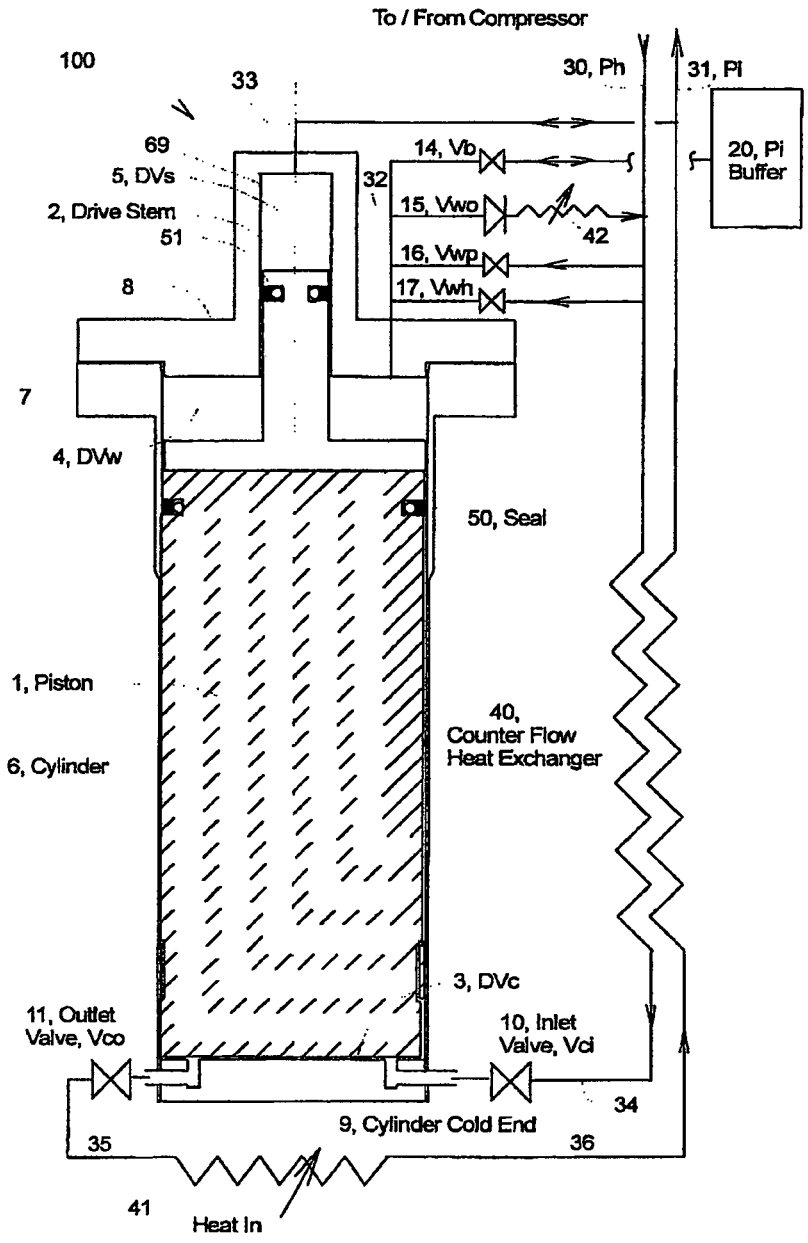
FIG. 1 shows engine 100 which adds a buffer volume and a buffer valve to the warm displaced volume of the engine described in U.S. Pat. No. 8,776,534.
Figure 2:
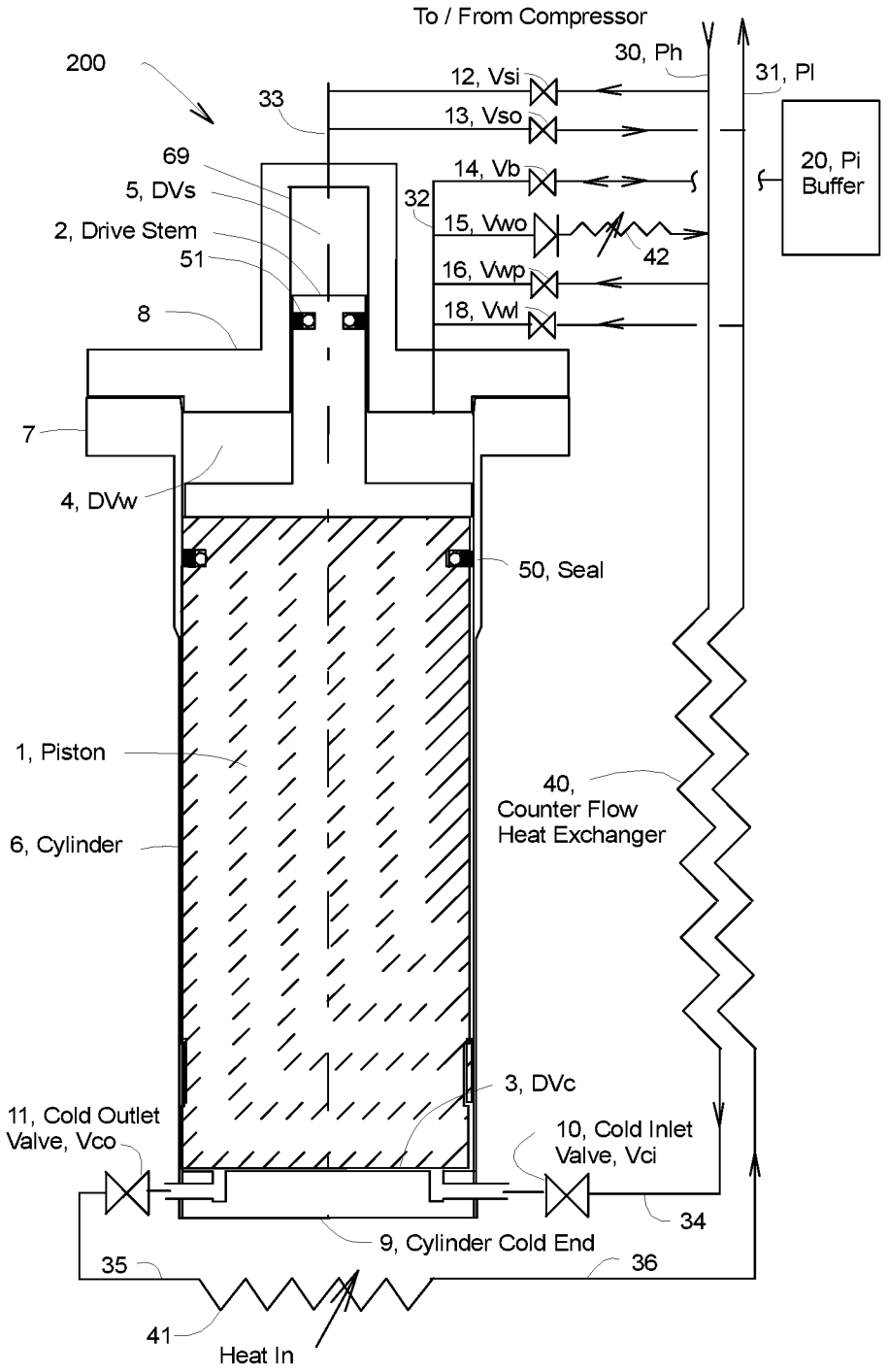
FIG. 2 shows engine 200 which adds a buffer volume and a buffer valve to the warm displaced volume of the engine described in U.S. patent application Ser. No. 61/313,868. It also adds a second valve between the high pressure line and the warm displaced volume.

The two embodiments of this invention that are shown in FIGS. 1 and 2 use the same number and the same diagrammatic representation to identify equivalent parts. Since expansion engines are usually oriented with the cold end down, in order to minimize convective losses in the heat exchanger, the movement of the piston from the cold end toward the warm end is frequently referred to as moving up, thus the piston moves up and down. The cycle description assumes that helium is supplied at 2.2 MPa and returned at 0.8 MPa.

FIG. 1 is a cross section/schematic view of engine assembly 100. Piston 1 reciprocates in cylinder 6 which has a cold end cap 9, warm mounting flange 7, and warm cylinder head 8. Drive stem 2 is attached to piston 1 and reciprocates in drive stem cylinder 69. The displaced volume at the cold end, DVc, 3, is separated from the displaced volume at the warm end, DVw, 4, by piston 1 and seal 50. The displaced volume above the drive stem, DVs, 5, is separated from DVw by seal 51. Line 33 connects DVs, 5, to low pressure, Pl, in low pressure return line, 31. Line 32 connects DVw 4 to buffer valve Vb, 14, valve VWo, 15, Valve Vwp, 16, and valve Vwh, 17. Buffer valve Vb, 14, is connected to buffer volume 20. Valve Vwo is connected to high pressure, Ph, in high pressure line 30 through heat exchanger 42. Valves Vwp, 16, and Vwh are also connected to high pressure line 30. The reason for having three valves connected to high pressure line 30 is to have ambient temperature gas flow into DVw, 4, through Vwp, 16, and Vwh, 17, then have the gas after it is heated by compression in DVw, 4, flow out through Vwo, 15, and cooled in heat exchanger 42 before flowing back into high pressure line 30. Valve Vwp, 16, differs from Vwh, 17, in allowing a high flow rate to pressurize DVw, 4, when piston 1 is at the cold end while Vwh, 17, has a restricted flow to control the piston speed as it moves down. Gas at high pressure in line 30 flows through counter-flow heat exchanger 40 then through line 34 to cold inlet valve Vci, 10, which admits gas to cold displaced volume DVc, 3. Gas flows out of DVc, 3, through cold outlet valve Vco, 11, then through line 35, cold heat exchanger 41, and line 36, to return to the compressor through counter-flow heat exchanger 40, all at low pressure.

FIG. 2 is a cross section/schematic view of engine assembly 200. This differs from engine assembly 100 in replacing valve Vwh, 17, which connects line 30 at Ph to DVw, 4, with valve Vwl, 18, which connects line 31 at Pl with DVw, 4, and adding valves Vsi, 12, and Vso, 13. Engine 100 drives the piston down by connecting Ph from line 30 to DVw, 4, through valve Vwh, 17, while maintaining Pl on drive stem 2. Engine 200 drives the piston down by connecting Ph from line 30 to DVs, 5, through valve Vsi, 12, while maintaining Pl in DVw, 4 by connecting it to line 31 through valve Vwl, 18.

Not shown is the option of replacing the pneumatic force on drive stem 2 with a mechanical force.

Figure 3:
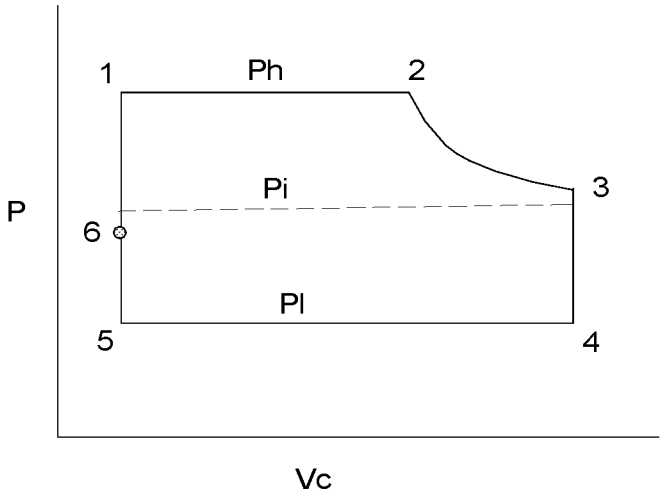
FIG. 3 shows a pressure-volume diagram for the engines shown in FIGS. 1 and 2.
Figure 4A:
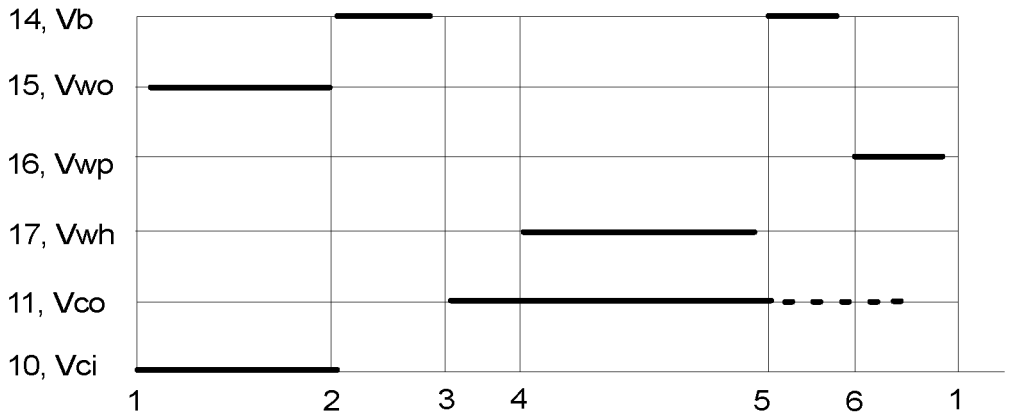
FIGS. 4*a, b*, and *c* show valve opening and closing sequences for the engines shown in FIGS. 1 and 2.
Figure 4B:
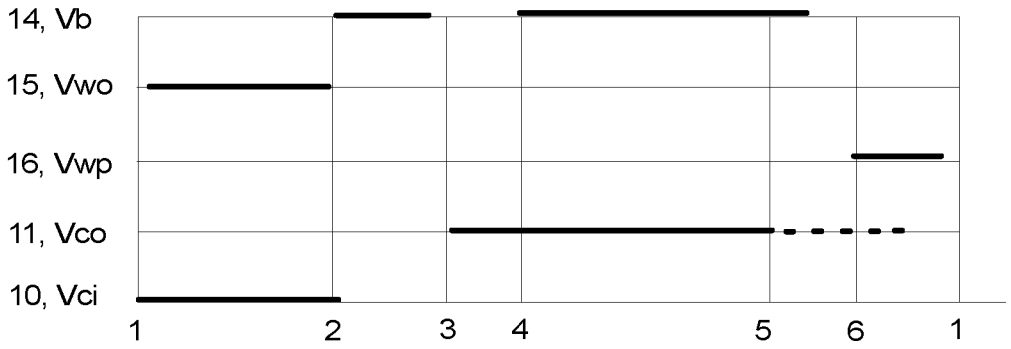
Figure 4C:
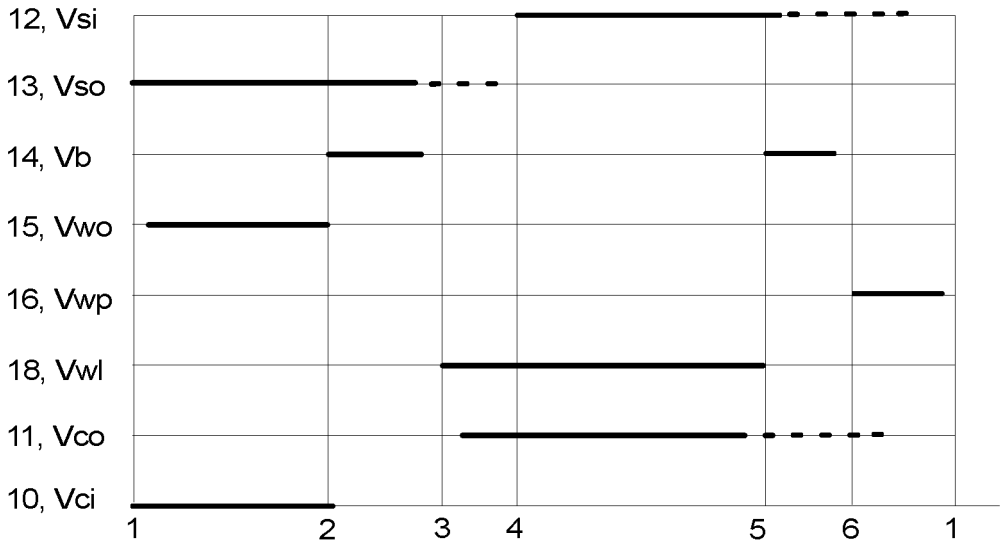

FIG. 3 shows the pressure-volume diagram for both engines 100 and 200, Vc being cold displaced volume DVc, 3. The area of the P-V diagram is equal to the refrigeration that is produced per cycle. It is an object of the design to maximize the area of the diagram with the minimum amount of gas. FIGS. 4*a* and 4*b* show valve opening and closing sequences for engine 100 and FIG. 4*c* shows valve opening and closing sequences for engine 200. The state point numbers on the P-V diagram correspond to the valve open/close sequence shown in FIGS. 4*a*, 4*b*, and 4*c*. The solid lines indicate when the valves are open and the dashed lines represent when they can be open or closed. Point 1 on the P-V diagram represents piston 1 at the cold end, minimum DVc. DVw is at Ph and DVs at Pl. Vci opens admitting gas at Ph to VDc. VDc increases while the gas in DVw is compressed above Ph because there is low pressure on drive stem 2. Gas in DVw is pushed out through valve Vwo to high pressure line 30. At point 2 piston 1 has moved more than two thirds of its way to the warm end. At this point Vci and Vwo are closed then Vb is opened so gas flows into the buffer volume and the pressure in DVc and DVw drops about 30% to 45% of the way to Pl as piston 1 continues to the warm end. At point 3 Vb is closed then Vco is opened and the pressure in DVc and DVw drops to Pl. DVw will increase slightly as the gas in line 32 expands from the pressure at point 3 to Pl. At point 4 Vwh is opened and piston 1 then moves to the cold end, point 5. Vwh is closed slightly before piston 1 reaches the cold end. Vco is closed at any time between points 5 and 1. At point 5 Vb is opened to allow gas to flow from buffer volume 20 to DVw and increase the pressure in VDw to the pressure at point 6 when Vb is closed. The pressure at this point is almost the same as the pressure in the buffer volume. At point 6 Vwb is opened to rapidly bring the pressure in DVw to Ph. Vwb is then closed before the cycle repeats starting at point 1. The gas flow into buffer volume 20 between points 2 and 3 is equal to the flow out between points 5 and 6 and results in an intermediate pressure of Pi in buffer volume 20. A reasonable size for buffer volume 20 for this embodiment is about 2.5 times DVw.

FIG. 4*b* shows the option of opening valve Vb at point 4, rather than Vwh, and closing it after reaching point 5, then opening and closing Vwp before opening Vci. This valve sequence option allows the intermediate pressure Pi in buffer volume 20 to be lower than the previous valve sequence, Vci to be closed sooner, i.e. point 2 is shifted to the left, and the gas in Dvc to expand to a lower pressure. The pressure in DVc and DVw can drop about 70% of the way from Ph to Pl as piston 1 moves from point 2 to point 3. It also eliminates the need for Vwh.

The valve timing diagram shown in FIG. 4*c* for engine 200 differs from the one for engine 100 in replacing valve Vwh, 17, with Vwl, 18, and adding valves Vsi, 12, and Vso, 13. Vsi admits high pressure gas to VDs, 5, to push piston 1 down between points 4 and 5, and Vso connects VDs, 5, to Pl to create a force imbalance that drives piston 1 up between points 1 and 3. Vwl, 18, opens at point 3 and lets the pressure in line 32 drop to Pl before Vco opens at point 4. The gas that is drawn in to DVw between points 4 and 5 is compressed and returned at high pressure to line 30 between points 1 and 2. This represents recovery of some of the work being done by the engine in the form of additional gas flow to the cold end which increases the refrigeration being produced. It is noted that Vsi and Vso are not needed if piston 1 is reciprocated by mechanical means. The area of drive stem 2 is in the range of 8% to 15% of the area of piston 1 at the cold end thus it uses about 3% of the flow from the compressor to drive piston 1 up and down when the temperature at the cold end, 9, is about 80 K. For the same expansion of gas from points 2 to 3 the increase in the percent of refrigeration that is produced is about the same for all cold temperatures. The increase in refrigeration due to work recovery however is proportional to (Th−Tc)/Th thus the extra valves for pneumatic drive engine 200 do not gain much over engine 100 below about 50K but have large gains for temperatures over 100K.

U.S. Pat. No. 8,783,045 by M. Xu et al describes a GM or a GM type pulse tube expander that uses a buffer volume connected to the warm end of the cylinder as a means to reduce the power input to the refrigerator. It does this by closing the supply valve from the compressor when the displacer reaches the top and then opening a valve to the buffer volume so the pressure drops towards the pressure in the buffer volume. The buffer valve is then closed and the valve that returns gas to the compressor is opened. Gas flows back to the cylinder from the buffer volume after the return valve is closed and before the supply valve is opened. The P-V diagram has to be rectangular, with no expansion or recompression, for this to reduce the flow to the expander each cycle. The GM and GM type pulse tubes have regenerators between the warm and cold displaced volumes thus there is never much of a pressure difference between the warm and cold ends. The Brayton piston on the other hand does not inherently have the same pressure on both ends of the piston. Expansion and recompression of the gas in a GM expander can be achieved by early closure of the supply and return valves but not by adding a buffer volume.

Adding a buffer volume to a gas balanced Brayton engine has a different effect than adding it to a GM or a GM type pulse tube expander. The Brayton engine produces more cooling per cycle because of the increase in the area of the P-V diagram. It is not obvious that this extra cooling can be provided by applying the buffer volume of '045 patent to the Brayton cycle engines U.S. Pat. No. 8,776,534 and application U.S. Ser. No. 61/313,868.

Table 1 provides an example of the refrigeration capacities that are calculated for pressures at Vci of 2.2 MPa and at Vco of 0.8 MPa. Helium flow rate from the compressor is 5.5 g/s. The piston diameter is 82.4 mm and the stroke is 25.4 mm. Heat-exchanger (HX) efficiency is assumed to be 98%. The refrigeration rates (Q) for engines 100 and 200 are based on the P-V diagram of FIG. 3 and are compared with the prior design that does not have expansion of the gas after point 2. Tc is the temperature of the gas flowing through Vci and N is the cycle's rate.

TABLE 1

Calculated Performance

| Engine | Prior | 100 | 200 |
|---|---|---|---|
| P-V Expansion-% | 0 | 36 | 36 |
| Recovery | No | No | Yes |
| Tc-K | 70 | 70 | 70 |
| N-Hz | 2.4 | 3.2 | 3.6 |
| HX Flow-g/s | 5.3 | 5.3 | 5.9 |
| Q-W | 270 | 370 | 410 |
| Tc-K | 140 | 140 | 140 |
| N-Hz | 4.7 | 6.2 | 7.6 |
| HX Flow-g/s | 5.3 | 5.3 | 6.3 |
| Q-W | 720 | 910 | 1,100 |

The percent increase in refrigeration due to the use of a buffer volume is more significant at lower temperatures because the heat exchanger loss is the same for engine 1 as for the prior engine. Some of the benefit of having more gas flow to the cold end in engine 2 relative to engine 1 is offset by more losses in the heat exchanger.

While expansion engines operating on the Brayton cycle have typically been used to produce refrigeration and liquefy gases at temperatures below 120K they can also be applied to cryopump water vapor at temperatures as high as 160K.

What is claimed is:

1. An expansion engine operating with a gas supplied from a compressor for producing refrigeration at temperatures below 160K, the gas supplied in a first line at a high pressure and returned in a second line at a low pressure, the expansion engine comprising: a piston in a cylinder, the piston having a drive stem at a warm end of the piston, a cold inlet valve at a cold end of the cylinder that opens to admit the gas from the first line to a cold displaced volume when the piston is near the cold end of the cylinder and while the piston moves at least two thirds of a way towards a warm end of the cylinder, and a cold outlet valve at the cold end of the cylinder that opens to exhaust the gas to the second line when the piston is near the warm end of the cylinder and as the piston moves to the cold end of the cylinder, wherein a force is applied to the drive stem to cause the driver stem to reciprocate; a buffer volume connected to a warm displaced volume between the warm end of the piston and the warm end of the cylinder outside an area of the drive stem by a third line having a buffer valve, the buffer valve being opened after the cold inlet valve closes and closed before the cold inlet valve opens, wherein the buffer volume receives and exhausts the gas only though the buffer valve and wherein the buffer volume is not connected to directly fluidly communicate with the cold displaced volume; and a set of valves to maintain pressure in the warm displaced volume at substantially the same pressure as in the cold displaced volume, while the piston is moving.

2. The expansion engine in accordance with claim 1, wherein the force on the drive stem is a pneumatic force.

3. The expansion engine in accordance with claim 2, wherein the pneumatic force on the drive stem is generated by the high pressure gas from the first line while the piston is moving towards the cold end and by the gas in the second line at the low pressure while the piston is moving towards the warm end.

4. The expansion engine in accordance with claim 3, wherein the set of valves includes a warm outlet valve that returns the gas to the first line at the high pressure when the piston is near the cold end of the cylinder and while the piston moves the at least the two thirds of the way towards the warm end, and a warm inlet valve that admits the gas from the second line at the low pressure when the piston is near the warm end of the cylinder and as the piston moves to the cold end.

5. The expansion engine in accordance with claim 1, wherein the force on the drive stem is generated by the gas in the second line at the low pressure which is supplied from and returned to the second line while the piston is reciprocating.

6. The expansion engine in accordance with claim 5, wherein the set of valves includes a warm outlet valve that returns the gas to the first line at the high pressure when the piston is near the cold end of the cylinder and while the piston moves at least halfway towards the warm end, and a warm inlet valve that admits the gas from one of the first line at the high pressure and the buffer volume when the piston is near the warm end of the cylinder and as the piston moves to the cold end.

7. The expansion engine in accordance with claim 1, wherein the force on the drive stem is a mechanical force.

8. The expansion engine in accordance with claim 1, wherein the buffer volume is connected to the warm displaced volume only through the third line.

9. The expansion engine in accordance with claim 1, wherein the buffer valve is opened to return the gas in the warm displaced volume to the buffer volume when the piston moves more than the two third of the way towards the warm end of the cylinder, and is closed when the cold displaced volume is maximized.

10. The expansion engine in accordance with claim 1, wherein the buffer valve is opened to admit the gas in the buffer volume to the warm displaced volume when the cold displaced volume is minimized, and is closed before the piston begins to move towards the warm end of the cylinder.

11. The expansion engine in accordance with claim 1, further comprising a heat exchanger, wherein the set of valves includes a warm outlet valve that connects the warm displaced volume to the first line to return the gas in the warm displaced volume to the first line, and the heat exchanger is disposed between the warm outlet valve and the first line.

12. The expansion engine in accordance with claim 1, wherein the set of valves includes a first warm inlet valve and a second warm inlet valve both of which admit the gas from the first line.

13. The expansion engine in accordance with claim 12, wherein the first warm inlet valve allows higher flow rate than the second warm inlet valve to pressurize the warm displaced volume when the piston is at the cold end of the cylinder.

14. The expansion engine in accordance with claim 12, wherein the second warm inlet valve has a restricted flow compared to the first warm inlet valve to control a speed of the piston as the piston moves toward the cold end of the cylinder.

15. The expansion engine in accordance with claim 1, wherein the buffer volume is at an intermediate pressure between the high and low pressures.

* * * * *